United States Patent [19]

Vonder

[11] 4,293,179

[45] Oct. 6, 1981

[54] CIRCUIT BOARD INTERCONNECTION SYSTEM

[75] Inventor: David L. Vonder, Addison, Ill.

[73] Assignee: GTE Automatic Electric Labs Inc., Northlake, Ill.

[21] Appl. No.: 81,516

[22] Filed: Oct. 3, 1979

[51] Int. Cl.[3] ..... H01R 23/70

[52] U.S. Cl. ..... 339/176 MP; 339/17 LC

[58] Field of Search ..... 339/176 MP, 17 L, 17 LC, 339/17 LM

[56] References Cited

U.S. PATENT DOCUMENTS

| | | | |
|---|---|---|---|
| 3,160,459 | 12/1964 | Greco et al. | 339/176 MP |
| 3,215,975 | 11/1965 | Kinkaid | 339/17 LC |
| 3,660,803 | 5/1972 | Cooney | 339/176 MP |
| 4,193,654 | 3/1980 | Hughes et al. | 339/17 LC |

*Primary Examiner*—John McQuade

*Attorney, Agent, or Firm*—Robert J. Black; Anthony Miologos

[57] ABSTRACT

A circuit board interconnection system comprising an edge mounted electrical connector and at least one cable connector. The edge mounted connector comprises a body having a plurality of electrical contacts retained thereon with each contact including a circuit board engaging portion and a terminal engaging portion. At least one receptacle is formed by a flange extending from the body about the terminal engaging portions. The cable connector comprises a body including a pluraity of terminals thereon connected to a source of electrical potential and arranged to be inserted into the edge connector receptacle electrically interconnecting respective terminals to edge connector terminal engaging portions.

8 Claims, 16 Drawing Figures

CIRCUIT BOARD INTERCONNECTION SYSTEM

BACKGROUND OF THE INVENTION

1. Field of the Invention

The present invention relates to electrical connectors and more particularly to a system and individual connectors for electrically interconnecting a cable of the type having a plurality of conductors to a printed circuit board.

2. Description of the Prior Art

A particular use for the connectors of a nature described is in the telephone switching field. It is often desirable in telephone switching equipment to provide for electrical interconnection between a cable and a printed circuit board which serves to modify an incoming electrical signal transmitted via the cable. It is also desirable to transmit the modified signal from the board through other electrical cables. Rapid interconnection and interchangeability of the various cables being connected to the circuit board is a beneficial feature.

Many such assemblies are of relatively complex design which require several multiple manual operations in order to satisfactorily provide the desired interconnections. Assembly, repair and disassembly is both time-consuming and expensive by manufacturing standards.

The printed circuit boards typically used for the above applications may include a plurality of conductive pads on the marginal portions thereof or a plurality of cladded bores on the board. It is desirable to develop a flexible system wherein the multiple individual conductors of a cable may be conveniently terminated to either a plurality of plated bores or terminated to conductive pads on the circuit board.

Some examples of the connectors used in the past are those found in the following U.S. patents:

U.S. Pat. No. 4,047,785 to Jayne describes a connector assembly having a separable cover means which slidably engages an insulative housing to cover the wire in addition to defining an opening for receiving a wire. The contacts positioned within the housing have a slotted end portion for electrically engaging the wire and an opposing end portion for slidably engaging a male pin.

U.S. Pat. No. 4,037,906 to Jayne relates to a connector having an insulating housing and contacts having a contacting portion within the housing and another portion extending from the housing. A cover is pivotably mounted to the housing for covering a recessed area within the housing.

U.S. Pat. No. 4,106,838 to Jayne relates to a flat cable connector assembly adapted to receive a flat cable having a plurality of aligned conductors and adapted to be plugged into an array or grid of conductor pins to interconnect the cable conductors and pins. A flat cable is positioned between a top and bottom body so that when the top and bottom bodies are assembled the contacts pass between adjacent conductors in the cable.

None of these connectors lend themselves to providing a system for the rapid connection and interchangeability of various cables to a printed circuit board.

SUMMARY OF THE INVENTION

In accordance with the present invention, there is provided an electrical interconnection system comprising an edge mounted electrical connector for providing electrical interconnection with a circuit board and at least one electrical cable connector. The edge mounted connector comprises an elongated body having a plurality of apertures and a plurality of electrical contacts being retained in respective apertures, each contact including a circuit board engaging portion and a terminal engaging portion. A pertaining flange depending from the body forms at least one receptacle about the terminal engaging portions.

The cable connector is comprised of a body including a plurality of apertures on a first surface. Each aperture includes an electrical contact therein forming a terminal connected to an individual conductor of an electrical cable. The cable connector is arranged to be inserted into the edge mounted connectors receptacle, connecting respective cable connector terminals to terminal engaging portions thus electrically interconnecting the circuit board.

BRIEF DESCRIPTION OF THE DRAWINGS

A better understanding of the invention may be had from the consideration of the following detailed description taken in conjunction with the accompanying drawings in which.

DESCRIPTION OF PREFERRED EMBODIMENTS

Figure 1:
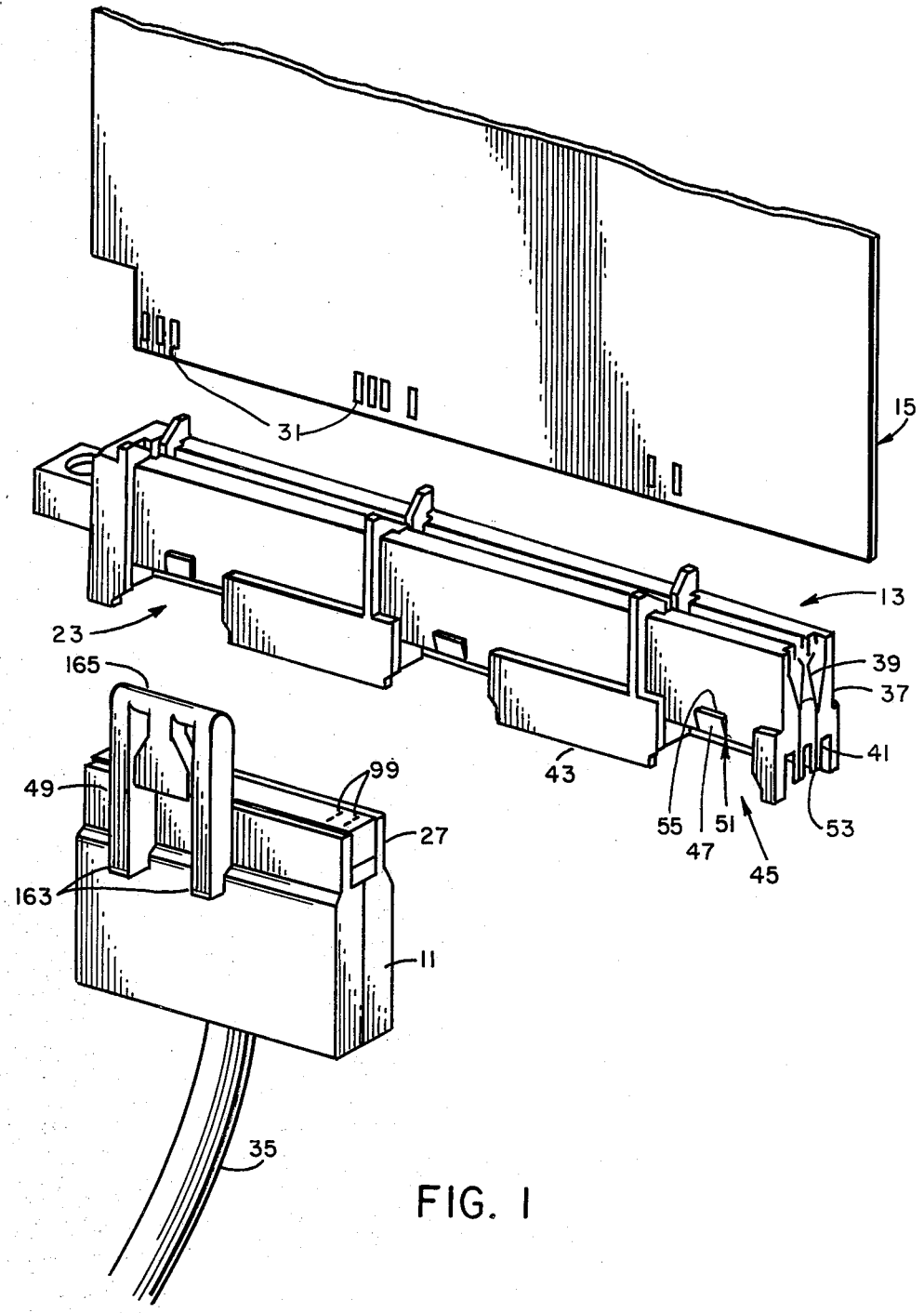
FIG. 1 is a exploded isometric view showing the interconnection of the edge connector and cable connector with the edge of a circuit board.

FIG. 1 illustrates the interconnection of cable connector 11 to a circuit board 15 via an edge mounted header or connector 13 for providing electrical connection of a cable 35 with the conductive portions or pads 31 on a circuit board 15. The edge mounted header 13 includes a receptacle portion illustrated at 23 for receiving a pluggable portion 27 of the cable connector 11.

Figure 2:
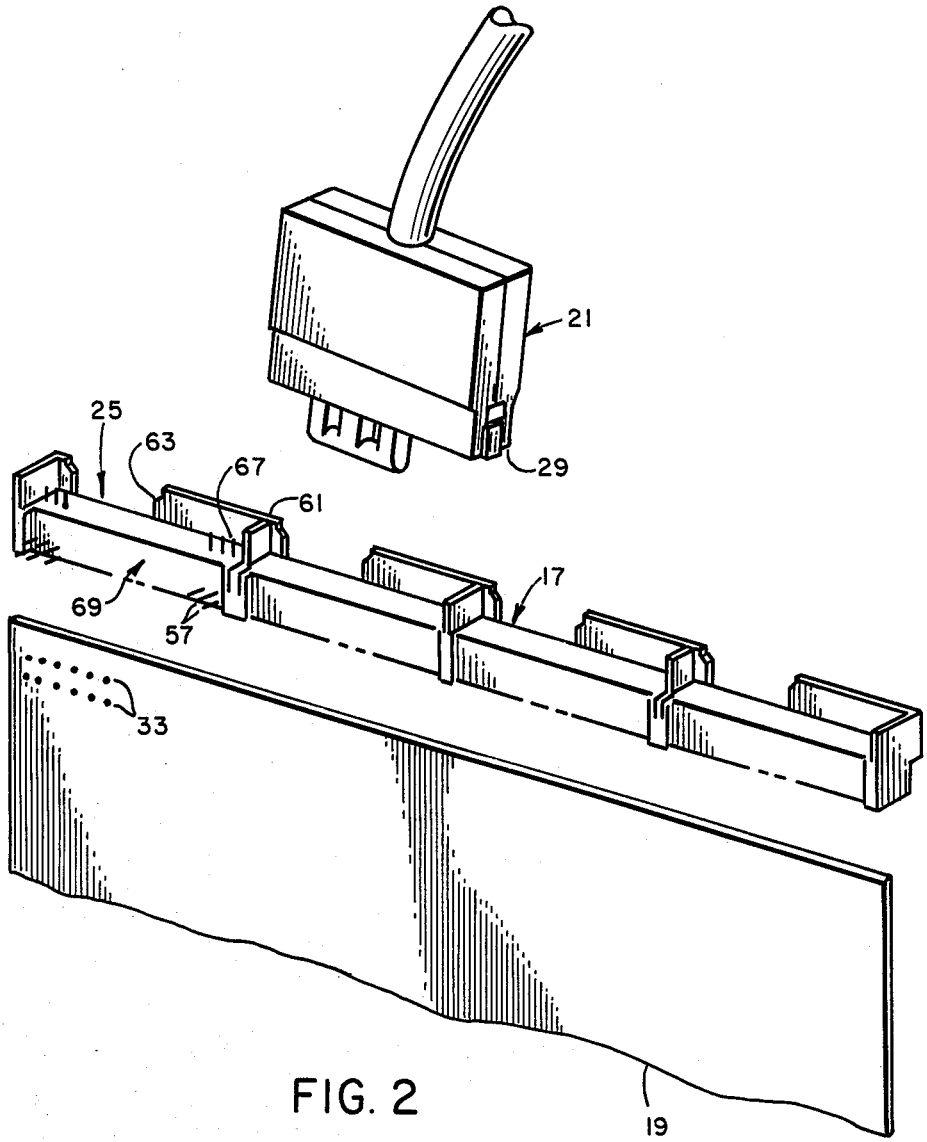
FIG. 2 is another exploded isometric showing the interconnection of the edge connector and cable connector with plated through holes of a circuit board.
Figure 4:
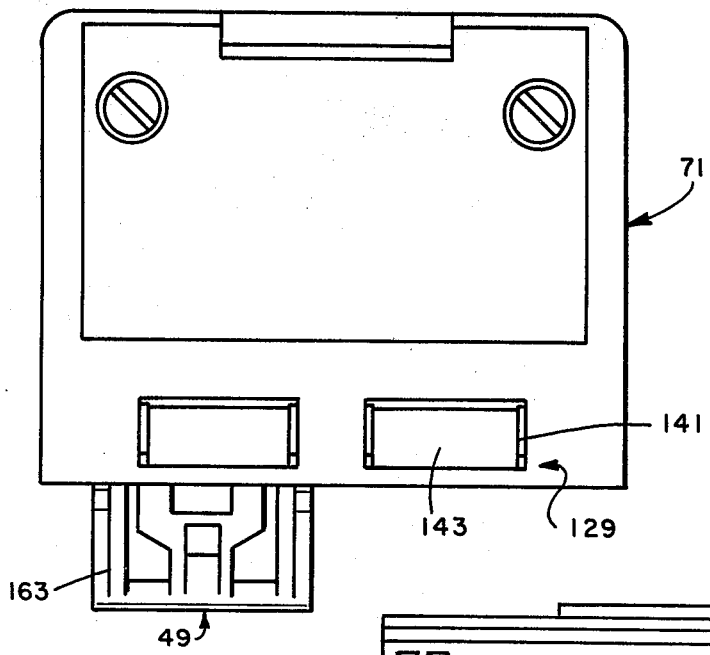
FIG. 4 is a front elevational view of the cable connector.
Figure 5:
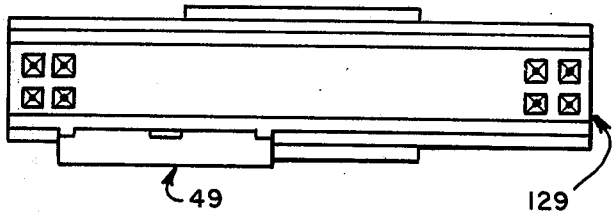
FIG. 5 is a bottom elevational view of the cable connector of FIG. 4.

FIG. 2 illustrates a similar arrangement wherein cable connector 21 has a pluggable portion 29 adapted to mate in a receptacle portion 25 of a side mounted header or connector 17. The side mounted header 17 is adapted to provide interconnection with a plurality of plated through holes 33 provided on a circuit board 19. The connector system of the present invention is suited for electrically connecting the individual conductors of a wire type cable 35 to either the conductive pads 31 or plated through holes 33 of respective boards 15 and 19.

The edge mounted header 13 includes a generally rectangular mounting member 37 having a central opening or zone therein for receiving circuit board 15. A plurality of apertures 41 which are arranged along a pair of spaced parallel rows have a plurality of contacts 39 mounted therein so that terminal engaging portions 53 which are pin shaped project outwardly from a bottom surface 51 thereof.

The electrical contacts 39 are retained in apertures 41 by a friction type fit so that flat portions or fingers of opposite contacts 39 face each other. The flat portions are bent inwardly to form a circuit board engaging portion which wipes against the conductive pads 31 as the circuit board 15 is inerted into the receiving zone of the mounting member 37. The contacts 39 yield outwardly due to their resilience and generate forces which serve to establish electrical continuity therewith and tends to prevent the circuit board 15 from separating from contacts 39.

The contacts 39 which are bent outwardly at the upper end include tabs. The mounting member 37 includes partitions which separate adjacent contacts 39 and prevents short circuiting. The partitions include shoulder portions for engaging the tabs on the upper end of the contacts 39 for limiting the inward deflection of the contacts 39 into the receiving zone.

A pertaining flange 43 projects outwardly in a direction normal to the bottom surface 51 so as to form a receptacle 23 about the terminal engaging portion 53. The flange 43 includes a slot 45 extending from an outer edge inwardly toward the bottom surface 51 of mounting member 37. The slot 45 is of sufficient width to receive the latching member 49 on cable connector 11. The mounting member 37 includes a protrusion 47 adjacent the bottom edge of bottom surface 51 intermediate the side edges of slot 45. As illustrated in detail in FIG. 1, the protrusion 47 is in the form of a tapered runner inclined upwardly and outwardly from the edge of bottom surface 51 and including an abrupt portion spaced inwardly from the bottom edge for engaging latching member 49. The flange 43 forms a receptacle or socket 23 which together with the slot 45 which forms a channel, serve to align and guide the cable connector 11 into the proper position. The protrusion 47 which lies along the channel path engages the cable connector 11 for securing the cable connector 11 to the connector 13 with respective contacts 39 engaging respective terminals 99 of the cable connector 11.

Figure 15:
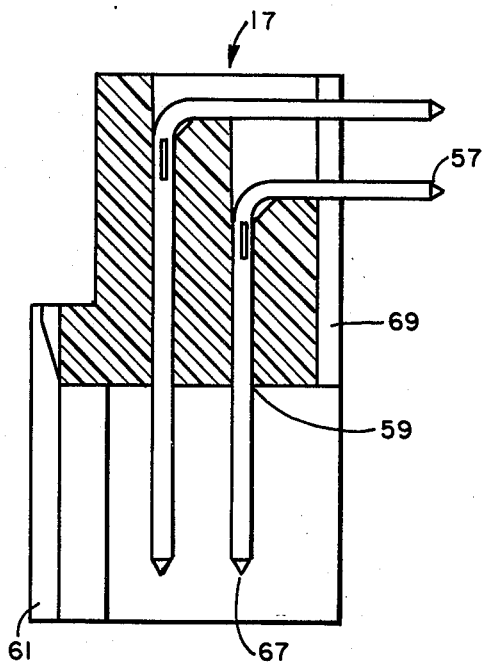
FIG. 15 is a side elevational view in section of a header assembly.

FIG. 2 illustrates in perspective the side mounted header 17 with FIG. 15 representing a cross section thereof. Side mounted header 17 includes a mounting member 69 with a plurality of apertures 59 therein arranged along a pair of parallel spaced rows. A plurality of contacts 57 are secured or retained to mounting member 69 in the apertures 59. Each of the contacts 57 are bent at a right angle so as to project outwardly from adjacent faces of the rectangular mounting member 69. The receptacle or socket 25 and the features relating thereto for receiving a pluggable portion 29 are similar to the features as described hereinbefore with regard to edge mounted header 13. The projecting pin portions 67 of contact 57, slot 63, flange 61 and the protrusion in the form of a tapered runner (not shown in FIG. 2) perform, respectively, similar functions and are of similar structure to the flange 43, slot 45, pins 53, and protrusion or tapered runner 47 as described with respect to the edge mounted header 13.

Figure 3:
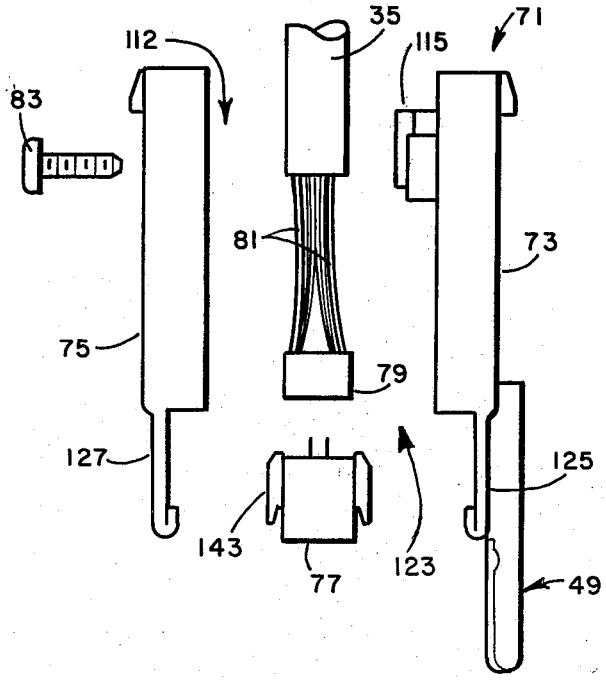
FIG. 3 is a schematic exploded side view of the cable connector.
Figure 8:
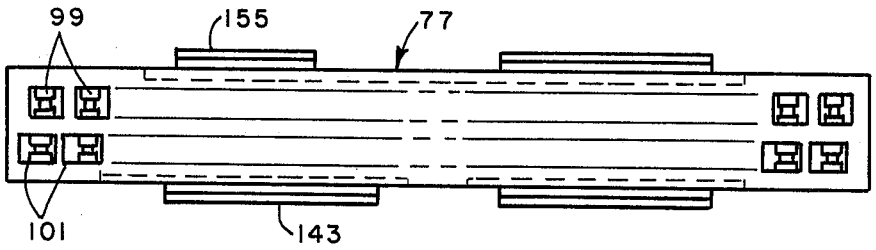
FIG. 8 is a top elevational view of the bottom body shown in FIG. 6.

The exploded view of FIG. 3 illustrates how the various parts of the cable connector 11 can be assembled to terminate individual conductors 81 from cable 35. As illustrated, the cable connector 11 includes a cover member 71 including a front section 73 and a mating back section 75. A bottom body 77 and top body 79 are interposed between the back section 75 and front section 73. A fastening means 83 in the form of a self-tapping screw is provided in respective sections for securing a top portion of the back section 75 and front section 73 together.

Figure 13:
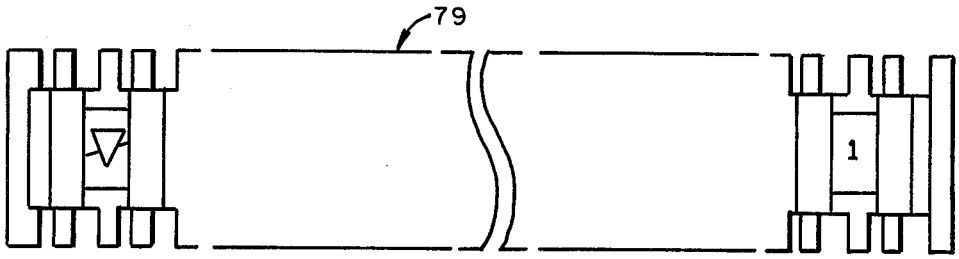
FIG. 13 is a top elevational view of the top body shown in FIG. 12.
Figure 12:
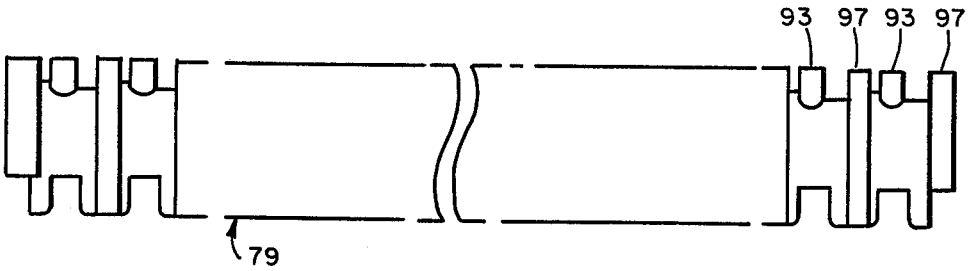
FIG. 12 is a side elevational view of the top body.
Figure 14:
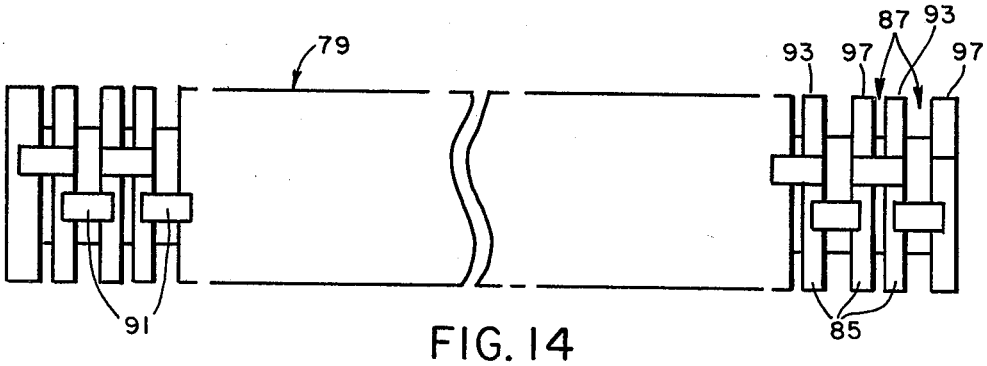
FIG. 14 is a bottom elevational view of the top body as shown in FIG. 12.

The top body 79 which is illustrated in the drawings in FIGS. 12, 13 and 14 is a rectangular shape elongated body having a plurality of partitions 85 along a bottom face thereof forming grooves 87 which are adapted to hold a plurality of conductors 81 in parallel spaced relation along a substantially common plane. As illustrated in FIG. 12, alternate partitions 93 are more closely spaced to one of the alternate adjacent partitions 97 so as to accommodate alternating individual conductors of different dimensions. The partitions 85 project downwardly below the bottom surface and are arranged to guide or align conductors 81 over the alternately spaced recesses 91.

The embodiment as above described is particularly desirable where it is necessary to terminate a cable 35 having conductors 81 including bare wires as well as insulated wires. This is particularly useful with cables of the coaxial type having a conductive mylar outer layer with a conductive bare wire in contact therewith. With the alternate spacing of the partitions 85 as illustrated in FIG. 12, the bare wires having a small diameter may be guided through the narrow groove between partition 85 and 93 while the insulating wire having a larger diameter may be guided through the larger groove through the partition 85 and 97. Due to the fact that alternate partitions 93 do not extend completely along the sides of the top body, each of the insulating wires has adjacent thereto a bare wire so as to further prevent cross talk in the connector itself. It is contemplated that alternate partitions 93 may have any spacing desirable depending on the width of the wires to be terminated. If the conductors are all insulated wire conductors of the same diameter, it would be desirable to have the partitions 93 evenly spaced from adjacent partitions 97.

The configuration of the bottom body 77 is more fully illustrated in FIG. 6 through 9. The bottom body 77 is an elongated rectangular insulating material having a plurality of openings 101 extending from one face thereof to an opposite face. The openings 101 are arranged along a pair of spaced parallel rows. A plurality of terminals 99 are mounted on the bottom body 77 and retained in the respective openings 101.

Figure 16:
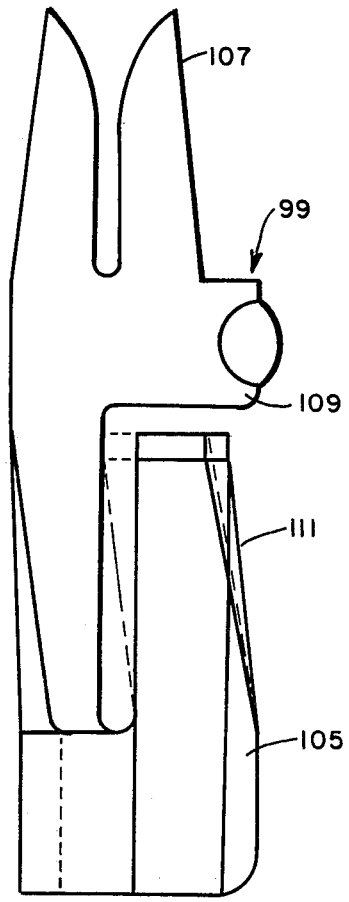
FIG. 16 is a side elevational view of a contact.

The configuration of one of the terminals 99 is illustrated in detail in FIG. 16. Each of the terminals 99 includes contact engaging portion in the form of a female disconnect portion 105 at one end, a conductor receiving portion 107 at the other end, and an intermediate retaining portion 109. The female disconnect portion 105 which is associated with one face of bottom body 77 includes a pair of engaging elements 111 which make mechanical and electrical contact with contacts 57 or 39 as may be present in a respective edge mounted header 13 or side mounted header 17 as previously discussed. The conductor receiving portion 107 which extends outward from the other face of bottom body 77 is generally in the form of opposing knife edges which are suited for piercing the insulation and engaging the bare wire of the conductors 81 for making electrical contact therewith. The intermediate retaining portion 109 is in the form of a projection which makes frictional contact with a respective opening 101 for holding each of the contacts 99 in place.

The conductive receiving portion 107 is offset from the longitudinal axis of the contact 99 and projects outwardly along one side thereof. The contacts are mounted along the pair of parallel rows in openings 101 so that the conductor receiving portions 107 of one row of contacts face one direction and the offset portion of the contacts of another row face the opposite direction.

The lower face of the top body 79 mates with the upper face of the bottom body 77 so that the aligned recesses 91 in the top body 79 are substantially in alignment and adapted to receive respective conductive receiving portions 107.

As the partitions 85 of the top body 79 engage the top face of the bottom body 77, passageways between the partitions 85 and the top surface of the bottom body 77 are formed which accommodate respective conductors 81 and provide for accurate alignment so as to provide proper engagement of the conductive receiving portions 107 with appropriate conductors 81.

A cover member 71 includes a top opening 113 for receiving cable 35 therethrough. The front section 73 includes a jaw 115 for gripping the cable 35. As the front section 73 and back section 75 are secured together the cable 35 is securely held by the jaw 115 between sections 73 and 75. The front and back sections 73, 75 each include respective peripheral flanges which mate to form respective top and side walls of the cover 71. A chamber 112 formed interior the cover 71 permits individual conductors 81 to be separated from the cable sheathing and spaced apart.

The cover 71 includes a pair of opposed retaining flanges 125, 127 depending from the cover 71 on either side of the bottom opening 123 for holding the top and bottom bodies 79, 77 in assembled relationship interposed between the flanges 125, 127 with the conductive receiving portions 107 engaging respective conductors 81. The flanges 125, 127 together with the top body 79 and bottom body 77 form a pluggable portion 129 adapted to fit into the respective receptacle 23 or receptacle 25 so that the contact engaging portions 105 mate with respective electrical contacts 39.

The top body 79 is held in position between the fixedly mounted bottom body 77 and the cover 71 intermediate the flanges 125, 127. Upward movement of the top body 79 in relation to the cover 71 is prevented by engagement with the bottom edges of respective side walls of the cover member 71 which are spaced away from the top face of the bottom body 77 a distance corresponding height of the top body 79.

Figure 6:
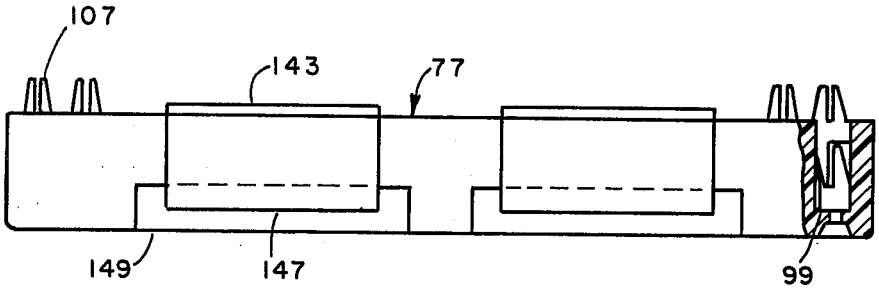
FIG. 6 is a side elevational view of the bottom body.
Figure 7:
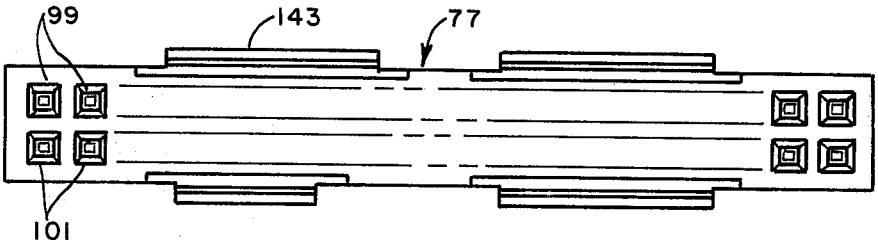
FIG. 7 is a bottom elevational view of the bottom body shown in FIG. 6.

The flanges 125, 127 and the bottom body 77 include complementary holes 141 and matching projecting bosses 143 for positioning the bottom body 77 and the cover 71. As illustrated in detail in FIG. 10, the holes 141 comprise longitudinal slots with each slot having the lower edge portion 145. As shown in FIG. 6, each of the projecting bosses 143 include a lip portion 147 which overlaps the lower edge portion 145 when the bottom body 77 and the flanges 125, 127 are assembled. The bottom body 77 is thus held stationary with respect to the cover 71.

At least one of the holes 153 (FIG. 10) and one of the matching projecting bosses 155 (FIG. 8) have matching dimensions different than the dimensions of the remaining holes 141 and projecting bosses 143 for polarizing the bottom body 77 and the cover member 71.

Figure 9:
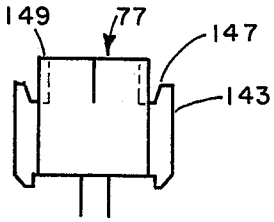
FIG. 9 is an end elevational view of the bottom body shown in FIG. 6.
Figure 11:
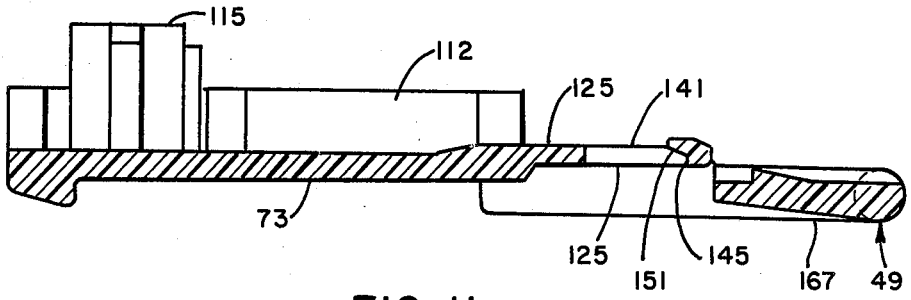
FIG. 11 is an end elevational view along section 11—11 of the cover as illustrated in FIG. 10.

To provide for a smooth pluggable portion 129, the lower edge portion 145 (as shown in FIG. 11) extends inwardly to form a recess 151 on one side of the cover 71 and a rib 150 on the other side of the cover 71. The bottom body 77 has a matching recess 149 (as shown in FIG. 9) for receiving the rib 150 with the lip 147 being substantially flush with the exterior surface of the pluggable portion 23.

Figure 10:
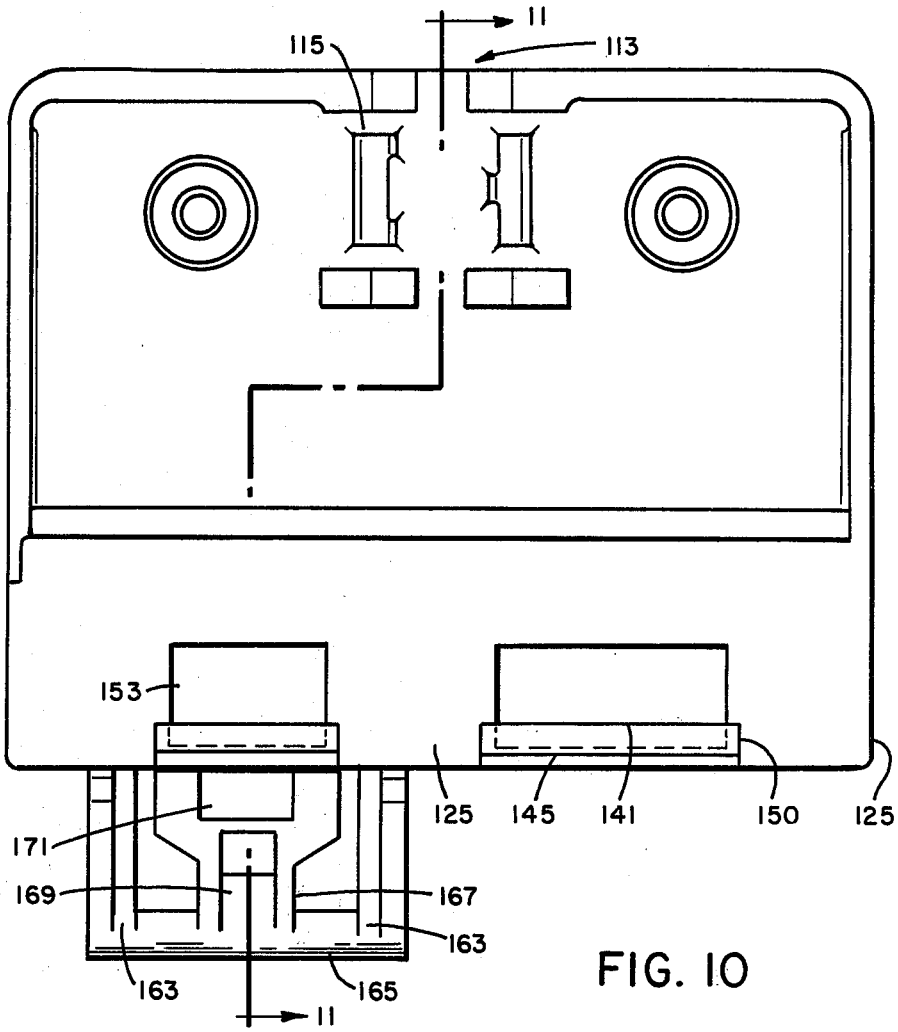
FIG. 10 is a side elevational view of the inside surface of the cover of FIG. 4.

As illustrated generally in FIG. 1 and in more detail in FIGS. 10 and 11, the cable connector 11 includes a latching member 49 mounted on the front section 73. The latching member 49 comprises a pair of arms 163 in substantially parallel alignment which project outwardly from at least one flange 125. A bar 165 which is connected to the arms 163 is spaced from the flange 125. A locking member 167 extends toward the pluggable portion 23 or bottom edge of flange 125 for yieldably engaging an exterior portion of a receptacle 23. Due to the torsional properties of the bar 165, the free end of the locking member 167 yieldably pivots about the bar 165. The locking member 167 includes a tapered recess 169 extending from a position adjacent the bar 165 inwardly toward the flange 125 and an abrupt recess 171 spaced inwardly of the tapered recess 169. As the locking member 167 is inserted into the slot 45 and the tapered runner 47 guides the tapered recess 169, the locking member 167 is guided inwardly until the abrupt recess 171 meets the abrupt portion 55 tapered runner 47 and the locking member 167 snaps inwardly.

In operation, the edge mounted connector 13 may be electrically connected to a circuit board 15 having conductive portions 31 on marginal edges and the side mounted header 17 may be connected to the same board or different circuit board 19 having plated through holes 33. Once the appropriate header 13 or 17 is connected, cables 35 may be connected to the board 15 or 19 via the cable connector 11. The pluggable portion 27 of the cable connector 11 may be fitted to within receptacle portion 23 or 25 so that the terminals 103 engage respective contacts 39, 67 to complete the circuit. The latching member 161 assures the mechanical integrity of the system.

The connector of the present invention may be used in conjunction with communication equipment to provide electrical interconnection and rapid disconnect of a cable having a plurality of individual conductors with a circuit board.

The present invention has been described with reference to a specific embodiment thereof, for the purpose of illustrating the manner in which the invention may be used to advantage, and it will be appreciated by those skilled in the art that the invention is not limited thereto. Accordingly, any and all modifications, variations, or equivalent arrangements which may occur to those skilled in the art should be considered to be within the scope of the invention.

What is claimed is:

1. A circuit board interconnection system for electrically interconnecting a plurality of conductors to one edge of a printed circuit board, said interconnection system comprising:

a circuit board connector including an elongated body having a plurality of apertures, each of said apertures including an electrical contact retained therein, each of said contacts including a circuit board engaging portion and a terminal engaging portion, said circuit board engaging portions in contact with said circuit board and electrically connecting said contacts to said circuit board, said circuit board connector further including at least one female receptacle portion defined by spaced side walls extending from said body about said terminal engaging portions; and a cable connector including a body having a male portion, said male portion including a plurality of terminals on one face thereof, each of said terminals electrically interconnected to one of said plurality of conductors, and said male portion inserted into said circuit board connector receptacle portion with said face engaging said circuit board connector terminal engaging portions, electrically interconnecting respective terminals to respective contacts.

2. A circuit board interconnection system as claimed in claim 1, wherein: said circuit board further includes conductive pads on a top and a bottom surface thereof in registration along said edge, said circuit board connector apertures arranged along a pair of spaced parallel rows and said circuit board engaging portions comprising flat contacts in one of said rows facing flat contacts in the other one of said rows projecting outwardly from a first face thereof, said flat contacts accommodating said circuit board top and bottom surfaces therebetween with each of said flat contacts engaging a respective one of said conductive pads, said terminal engaging portions comprising terminal engaging pins projecting outwardly from a second face opposite said first face.

3. A circuit board interconnection system as claimed in claim 1 wherein: said circuit board includes plated holes in registration along said edge, and said circuit board connector apertures are arranged along a pair of spaced parallel rows, said circuit board engaging portions comprising circuit board engaging pins projecting outwardly from a first face thereof and adapted to be inserted through said plated holes with each circuit board engaging pin inserted into a respective one of said circuit board holes, said terminal engaging portions comprising terminal engaging pins projecting outwardly from a second face, adjacent said first face.

4. A circuit board interconnection system as claimed in claim 2, wherein; said cable connector face is arranged as a planar surface including a plurality of apertures arranged along a pair of spaced and parallel rows each of said cable connector apertures including a respective one of said cable connector plurality of terminals therein, and each of said terminals including a female contact portion adapted to accept a respective one of said circuit board connector terminal engaging pins.

5. A circuit board interconnection system as claimed in claim 2, wherein: each of said flat contacts include a free end and a fixed end, each of said free ends including an inwardly bent portion which engages and wipes against a respective circuit board conductive pad and each of said fixed ends integrally joined to a respective one of said terminal engaging pins.

6. A circuit board interconnection system as claimed in claim 2, wherein: said circuit board connector elongated body comprises a longitudinally oriented mounting member having said plurality of apertures arranged thereon, spaced and parallel side walls integrally mounted to said mounting member and oriented in a mutual orientation with said flat contacts defining a circuit board receiving portion therebetween, each of said side walls further including transversely oriented partitions between each of said flat contacts electrically isolating each flat contact from an adjacent contact.

7. A circuit board interconnection system as claimed in claim 6, wherein; there is further included a plurality of said cable connectors and said circuit board connector further includes a plurality of female receptacle portions defined by a plurality of pertaining flanges extending parallel to said terminal engaging pins from said body sidewalls, said flanges encompassing a selected number of terminal engaging pins and each female receptable portion arranged to accept one of said cable connectors therein.

8. A circuit board interconnection system as claimed in claim 3, wherein there is further included a plurality of said cable connectors and said edge connector further includes a plurality of female receptacle portions defined by a plurality of pertaining flanges extending parallel to said terminal engaging pins from said body, said flanges encompassing a selected number of terminal engaging pins and each female receptacle portion arranged to accept one of said cable connectors therein.

* * * * *